US011173329B2

(12) United States Patent
Wright

(10) Patent No.: US 11,173,329 B2
(45) Date of Patent: Nov. 16, 2021

(54) PORTABLE FIREWALL

(71) Applicant: David C. Wright, Spring, TX (US)

(72) Inventor: David C. Wright, Spring, TX (US)

( * ) Notice: Subject to any disclaimer, the term of this patent is extended or adjusted under 35 U.S.C. 154(b) by 0 days.

(21) Appl. No.: 16/468,255

(22) PCT Filed: Dec. 9, 2017

(86) PCT No.: PCT/US2017/065640
§ 371 (c)(1),
(2) Date: Jun. 10, 2019

(87) PCT Pub. No.: WO2018/107172
PCT Pub. Date: Jun. 14, 2018

(65) Prior Publication Data

US 2020/0094087 A1 Mar. 26, 2020

Related U.S. Application Data

(60) Provisional application No. 62/432,442, filed on Dec. 9, 2016.

(51) Int. Cl.
*A62C 3/02* (2006.01)

(52) U.S. Cl.
CPC ..... *A62C 3/0257* (2013.01)

(58) Field of Classification Search
CPC ..... A62C 3/0257; A62C 2/06; A62C 2/24; A62C 2/241; A62C 2/246; A62C 3/0214; A62C 3/0264; A62C 3/0292
USPC ..... 169/48, 49–51; 52/29, 220.8, 23; 434/226
See application file for complete search history.

(56) References Cited

U.S. PATENT DOCUMENTS 4,311,199 A 1/1982 Elias
5,203,707 A * 4/1993 Musto ..... A62C 99/0081 434/226
6,330,771 B1 * 12/2001 Hester, Jr. ..... E04H 3/08 52/106

(Continued)

FOREIGN PATENT DOCUMENTS

CN 201180320 Y * 1/2009 ..... E04B 1/94
CN 102021984 A * 4/2011 ..... E04F 11/02

(Continued)

*Primary Examiner* — Steven M Cernoch
(74) *Attorney, Agent, or Firm* — Matthews, Lawson, McCutcheon & Joseph, PLLC

(57) ABSTRACT

A self-contained, portable firewall is provided having a rectangular configuration with a catwalk and a railing on the top side for accommodating a plurality of manned firefighting stations. The catwalk can comprise two openings, which can be covered by doors or hatches, that allow exit and entry of the manned firefighting stations through stairs located within the firewall structure. The stairs terminate at the floor and lead to a plurality of reinforced doors. Embodiments of the firewall comprise central doors having side doors flanking each central door, and each central door operatively associated with a status light. The manned firefighting stations are fed from at least one fluid input located at the bottom of the firewall structure, and the firewall structure further comprises a plurality of vents, fans and fume hoods.

12 Claims, 10 Drawing Sheets

(56) References Cited

U.S. PATENT DOCUMENTS

| | | | | |
|---|---|---|---|---|
| 6,438,900 | B1 * | 8/2002 | Page | E04H 6/04 52/2.16 |
| 7,749,380 | B2 * | 7/2010 | Yungner | B60P 3/14 135/88.13 |
| 7,909,111 | B1 * | 3/2011 | Hinojosa | A62C 35/58 169/16 |
| 8,534,370 | B1 * | 9/2013 | Al Azemi | A62C 31/24 169/15 |
| 8,739,482 | B1 | 6/2014 | Feil, III et al. | |
| 2005/0115722 | A1 | 6/2005 | Lund et al. | |
| 2012/0077429 | A1 * | 3/2012 | Wernimont | F24F 3/161 454/187 |
| 2015/0376897 | A1 | 12/2015 | Bigelow et al. | |

FOREIGN PATENT DOCUMENTS

| | | | | |
|---|---|---|---|---|
| CN | 102526911 A | | 7/2012 | |
| KR | 2016-33255 | * | 5/2016 | A62C 2/06 |

* cited by examiner

PORTABLE FIREWALL

REFERENCE TO RELATED APPLICATIONS

The present application is a US national stage application claiming priority to Patent Cooperation Treaty (PCT) Application No. PCT/US17/65640 filed 11 Dec. 2017, that in turn claims priority to and benefit of U.S. Provisional Application No. 62/432,442, filed 9 Dec. 2016, and entitled "Portable Firewall." The content of the above-referenced Patent Cooperation Treaty (PCT) Application No. PCT/US17/65640 is incorporated herein, by reference, in its entirety.

FIELD

The present application relates, generally, to a firewall structure which is not integrally connected to a larger building structure, and is, therefore, portable and movable from location to location on a hazardous area, such as a drilling rig where fire protection is necessary.

BACKGROUND

Firewalls are well known in the art as structures that are capable of preventing and/or retarding the spread of a fire from one area of a structure to another. Often firewalls are built directly into the structure of a building, terminating at a reinforced concrete slab or at another firewall, as part of a building code. These firewalls are useful for buildings and other structures where a hazardous location is determined and known to be located prior to any occurrence of a fire.

However, it is often not possible to anticipate a fire hazard. Portable firewalls are therefore also known in the art. An example of such a firewall can be found in U.S. Pat. No. 4,311,199 to Elias, which is typical of the prior art. Such a firewall is designed to be rapidly assembled and deployed in outdoor areas as a barrier for wildfires and other uncontrolled burns, where the hazardous location may change.

However, these firefighting firewalls are not generally designed for areas in which there is a continuous fire hazard due to, for instance, electrical equipment being operated in proximity to volatile compounds that may escape as vapors or aerosols and increase the ignition risks of incidental sparking or shorting of electrical equipment. Such areas are often present on, e.g., oil rigs or construction sites. However, depending on the specific work being performed, the hazardous area may change over the course of a job.

Hazardous areas are commonly classified according to the criteria promulgated by the National Fire Protection Association (NFPA), whose standards are also incorporated into the U.S. Code of Federal Regulations (CFR). A need exists for a portable firewall which can provide adequate protection for at least class 1, division 2 hazardous areas according to the NFPA standards.

Embodiments of the present disclosure, described herein, meet these needs.

SUMMARY

The present application is directed to an inventive system and method for a portable firewall which can be bolted or welded to a vessel.

In art embodiment, the invention comprises a portable firewall structure that can include an internal space that is defined by a first lateral wall, second lateral wall, first side wall, second side wall, floor, and ceiling. At least one (and optionally two or more) internal stairway(s) are located within the internal space and comprise an upper end and a lower end. The upper end can terminate at a first stairway entrance/exit located in the ceiling. Optionally, a door (e.g., fireproof door, hatch-type door) can be installed for closing the stairway entrance/exit to the stairs. The lower end can terminate adjacent to a central door(s) in a lateral wall. A plurality of firefighting stations can be located along the ceiling, each firefighting station comprising two or more pressurized hoses extending beyond either lateral wall, and at least one valve control tree located at either side wall that can be fluidly connected to the plurality of firefighting stations communicating fluid received from a fluid input (connected with a conduit along the side wall). The portable firewall can include a plurality of vents, which can be located along the ceiling. The first and second lateral walls of the portable firewall can further comprise three egress lights, and the portable firewall can comprise at least one 240V outlet.

The portable firewall can include a second internal stairway located within the internal space, which can include an upper end and a lower end. The upper end of the second internal stairway can terminate at a second stairway entrance/exit located in the ceiling, and a door can be installed for closing the second stairway entrance/exit to the stairs. The lower end of the stairway can terminate adjacent to a second door in the second lateral wall. In an embodiment, the first and second doors in the first and second lateral walls are centrally located at the floor of the portable firewall, and the first stairway entrance/exit and the second stairway entrance/exit can be distally located proximate to the first side wall and the second side wall, respectively.

The first lateral wall of the portable firewall can further comprise a plurality of fans to stimulate air exchange through the plurality of vents, wherein each fan of the plurality of fans can be partially enclosed by a fume hood. A railing can extend upwards from the first lateral wall and the second lateral wall, and the first side wall and the second side wall, thereby enclosing the ceiling. The first lateral wall, the second lateral wall, or combinations thereof, can further comprise a plurality of lights proximate to the ceiling. The portable firewall can include at least one valve control tree that can be located proximate to the first side wall, wherein the fluid input can communicate with the at least one valve control tree by means of a conduit extending along the first side wall. In an embodiment, the portable firewall can further comprise at least a second valve control tree that can be located on the ceiling proximate to the second side wall, wherein the at least a second valve tree is in fluid communication with the plurality of firefighting stations, and wherein the at least a second valve tree communicates with a second fluid input by means of a conduit extending along the second side wall.

In an embodiment, the portable firewall may comprise six doors, with two doors to either side of each central door in its respective lateral wall. For example, the first lateral wall can further comprise a third door and a fourth door distally located at the floor of the portable firewall, proximate to the first side wall and the second side wall, respectively, and the second lateral wall can further comprise a fifth door and a sixth door distally located at the floor of the portable firewall, proximate to the first side wall and the second side wall, respectively. The first lateral wall of the portable firewall can further comprise three egress lights corresponding and adjacent to the first door, the third door, and the fourth door, respectively, and the second lateral wall of the portable firewall can further comprise three egress lights corresponding and adjacent to the second door, the fifth door, and the sixth door, respectively, wherein each of the egress lights can indicate whether the corresponding door is opened or closed.

The above general descriptions and the following detailed descriptions are merely illustrative of the generic invention, and additional modes, advantages, and particulars of this invention will be readily suggested to those skilled in the art without departing from the spirit and scope of the invention.

BRIEF DESCRIPTION OF THE DRAWINGS

In the detailed description of the embodiments, presented below, reference is made to the accompanying drawings.

Figure 1:
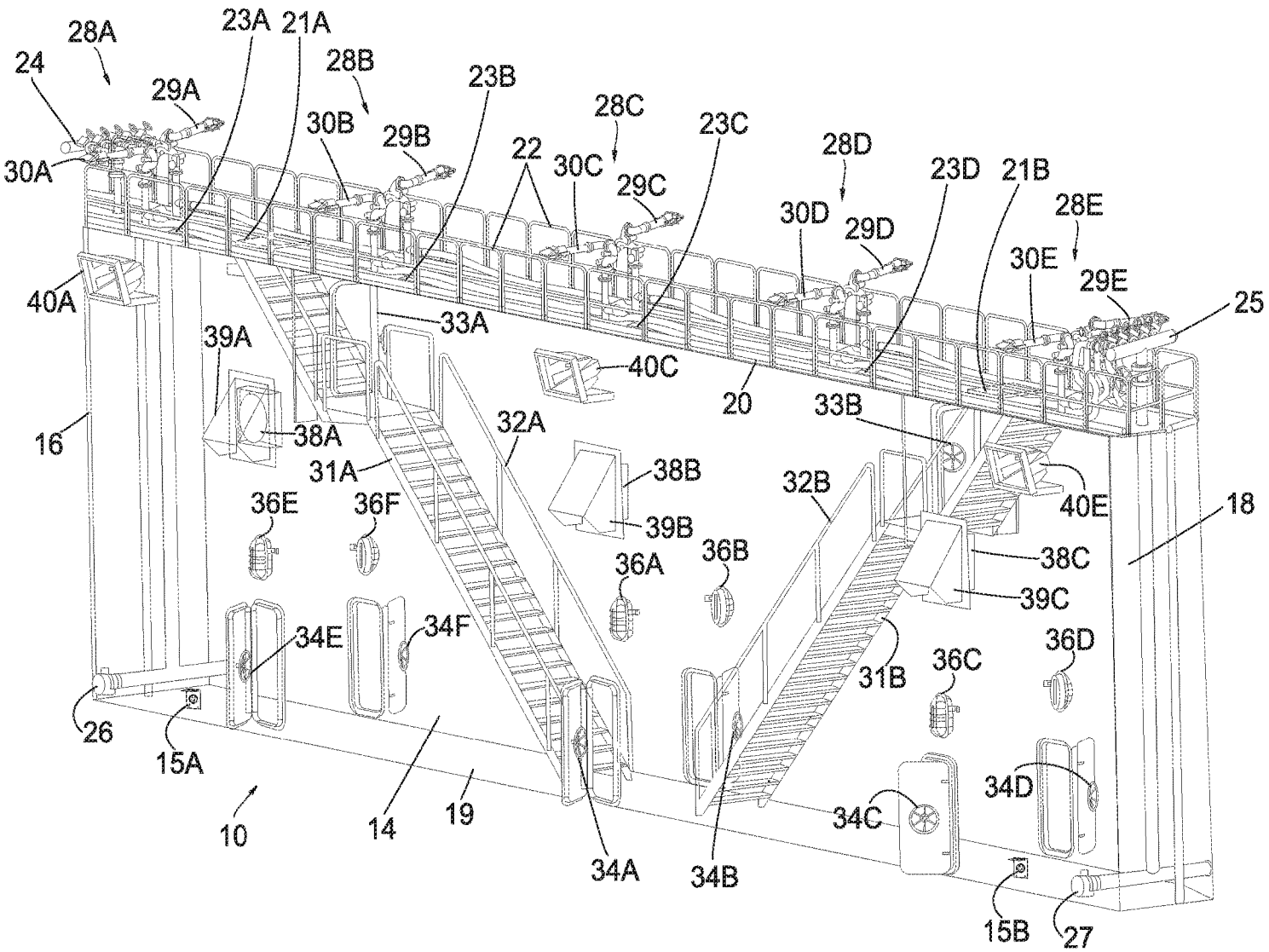
FIG. 1 depicts a semi-transparent view of an embodiment of a firewall as described in the present disclosure.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Embodiments of the present disclosure relate, generally, to a self-contained, portable firewall apparatus that can be placed at different locations within a building or structure to provide a fire-resistant barrier. The self-contained, portable firewall can provide protection for at least class 1, division 2 hazardous areas, while meeting the NFPA standards.

Referring to FIGS. 1-10, the embodiment of the firewall 10, as shown, can consists of two lateral sides 12 (shown in FIGS. 2 and 9), 14, two longitudinal sides 16, 18, a floor 19, and a ceiling walkway 20. As depicted, the sides 12, 14, 16, 18 can enclose a space that is at least wide enough for a worker to fit through the space.

As shown, ceiling walkway 20 can be flanked by guardrails 22 on either side. Ceiling walkway 20 can comprise a plurality of manned firefighting stations 28A-28E, While the embodiment of the firewall 10, shown in FIGS. 1-10, is depicted with a total of five manned firefighting stations, it can be appreciated that other embodiments may contain a fewer or greater number of firefighting stations, as dictated by the length of the firewall 10, which is not intended to be restricted by the present disclosure.

Manned firefighting stations 28A-28E can comprise a plurality of hoses 29A-29E and 30A-30E, which are mounted in pairs at intervals along the length of the ceiling walkway 20. In the depicted embodiment, each pair of hoses (e.g., 29A and 30A) are pointed in opposite directions over the guardrails 22. It can be appreciated that other configurations of hoses may exist in embodiments of the firewall 10. The hoses 29A-29E and 30A-30E are usable to allow workers to spray water, or a suitable extinguishing chemical, from a safe height and/or position, in the event of a fire.

In the depicted embodiment, the hoses 29A-29E and 30A-30E can run to at least one of the depicted two valve control trees 24, 25, which can be located on either side of the length of the ceiling walkway 20. Each valve control tree 24, 25 can be fluidly connected to an input hose that can run down a respective longitudinal side 16, 18 of the firewall 10, and can terminate at fluid inputs 26, 27.

In addition to comprising the manned firefighting stations 28A-78E, ceiling walkway 20 can comprise a plurality of stairway entrances/exits 21A, 21B, as well as a plurality of vents 23A-23D. The stairway entrance/exits 21A, 218 can be usable to allow safe entry and exit from the ceiling walkway 20 from within the firewall 10, thus avoiding exposure of personnel to additional hazards, e.g., external ladders, which may not be usable in the event of an uncontrolled fire.

Figure 4:
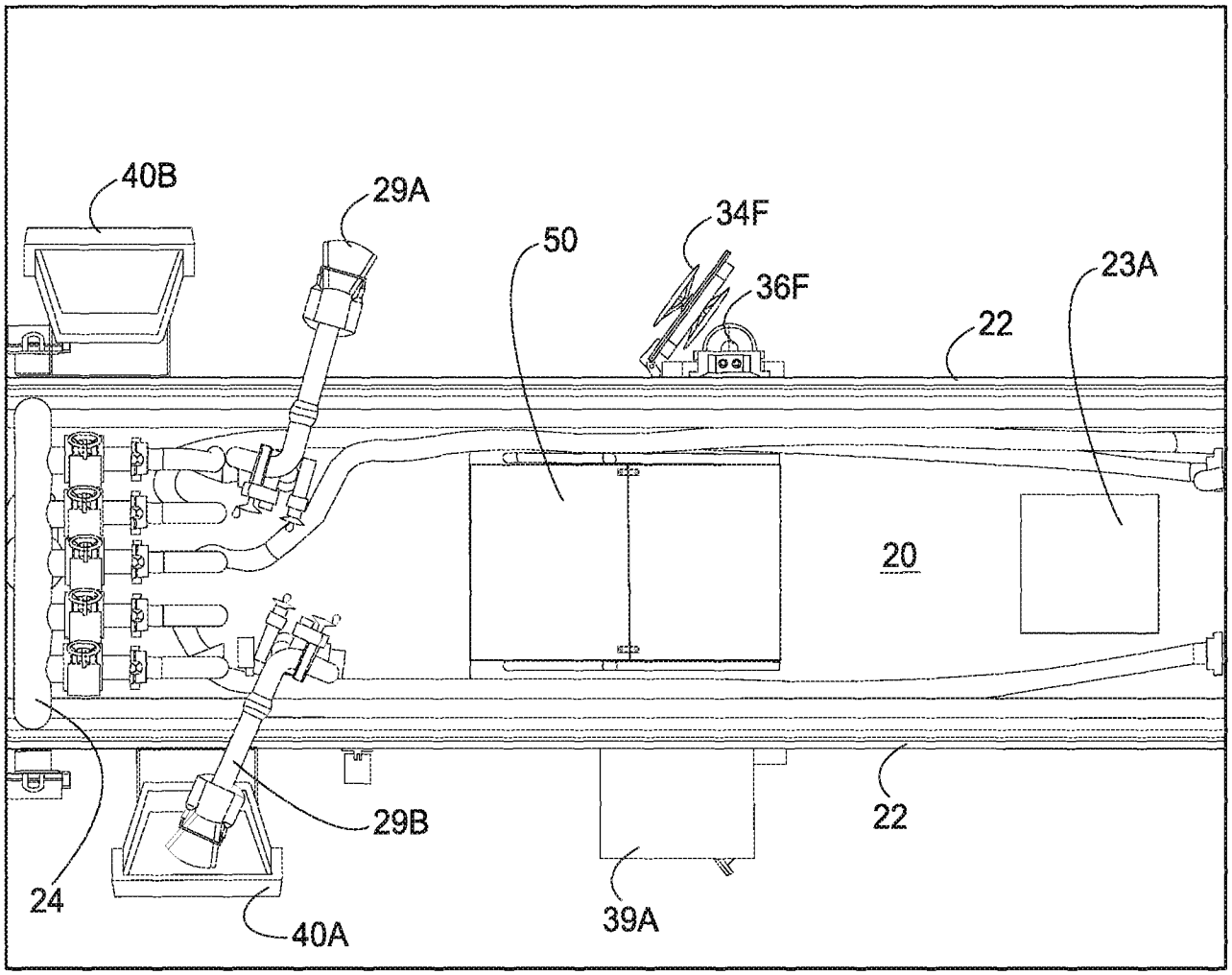
FIG. 4 depicts another partial overhead view of an embodiment firewall as described in the present disclosure.

In an embodiment of the firewall 10, the plurality of stairway entrances'exits 21A, 21B can lead to stairways 31A, 31B, which can provide a path from the ceiling walkway 20 to the floor 19 within the firewall 10 (i.e., between the lateral sides 12, 14). The stairways 31A, 3113 can comprise railings 32A, 32B, respectively. In an embodiment, the stairways can each comprise an upper door 33A, 33B (see also FIGS. 5 and 6) that can keep the ceiling walkway 20 isolated from the inside of the firewall 10. Further, the upper end of the first and second stairways 31A, 31B can terminate at a first stairway entrance/exit and a second stairway entrance/exit, respectively, which is located in the ceiling 20, and a door 50, as shown in FIG. 4, (e.g., fireproof or blast resistant door, a hatch or hatch-type door, a hinged door) can be installed for closing each of the first and second stairway entrances/exits to the stairways 31A, 31B.

In an embodiment of the firewall 10, the stairways 31A, 31B can terminate in front of central doors 34A, 34B, as shown. In addition to these central doors, the firewall can comprise, in an embodiment, side doors 34C-34F, flanking each central door on either side of the respective lateral sides 12, 14. Each door 34A-34F or opening thereof located at the floor of the firewall 10 can be associated with a respective egress light 36A-36F, which can light or illuminate the surrounding area depending on the opened/closed position of the door 34A-34F or opening, thus allowing personnel to verify the door is secured. All doors 34A-34F as well as upper doors 33A-33B are blast proof as well as fire resistant.

Embodiments of the firewall 10 can include vents 23A-23D, which can provide an exchange of air between the firewall 10 and the outside air. This exchange of air can be additionally provided by fans 38A-38C, which can be located on the lateral side 12 of the firewall 10. The fans 38A-38C, in an embodiment, can be protected by fume hoods 39A-39C and can provide circulation of air into the firewall 10 by creating positive or negative pressure differential. In an embodiment, fans 38A-38C may be located or duplicated on the other lateral side 14 (not shown). Embodiments of the firewall 10 can include an additional plurality of lights 40A-40F (lights 408, 40D and 40F are not shown in FIG. 1), which are depicted as flood lights in FIG. 1.

As shown, the firewall 10 can comprise electrical equipment that can be powered by at least one (in the depicted embodiment, two) electrical outlets 15A, 15B, which can be located at the bottom of the firewall 10 and power egress lights 36A-36F and fans 38A-38C. In the depicted embodiment, these outlets 15A, 15B can be 240 volt outlets; however, other voltage outlets can be used.

Figure 2:
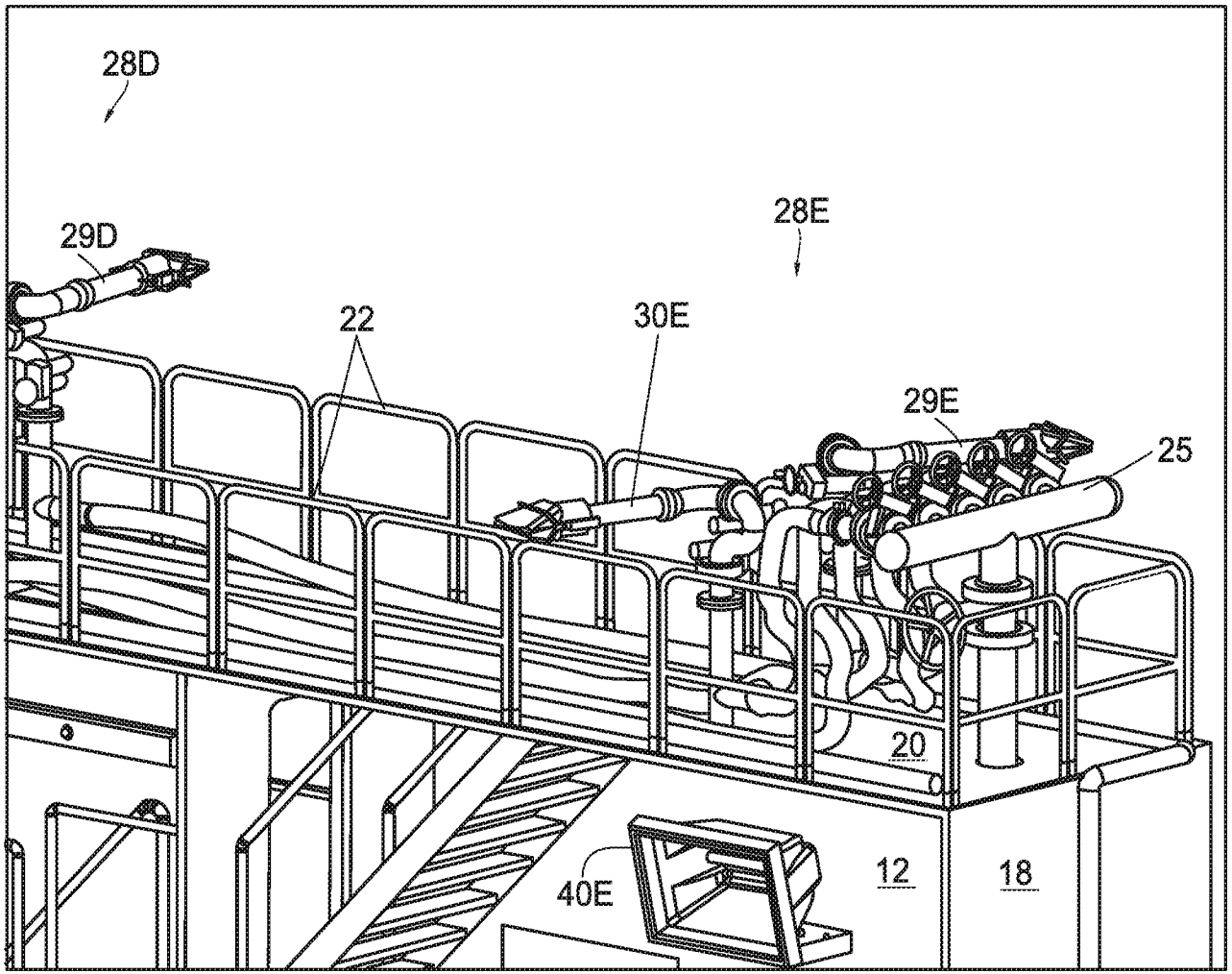
FIG. 2 depicts a zoomed-in view of an embodiment of a valve tree as described in the present disclosure.
Figure 3:
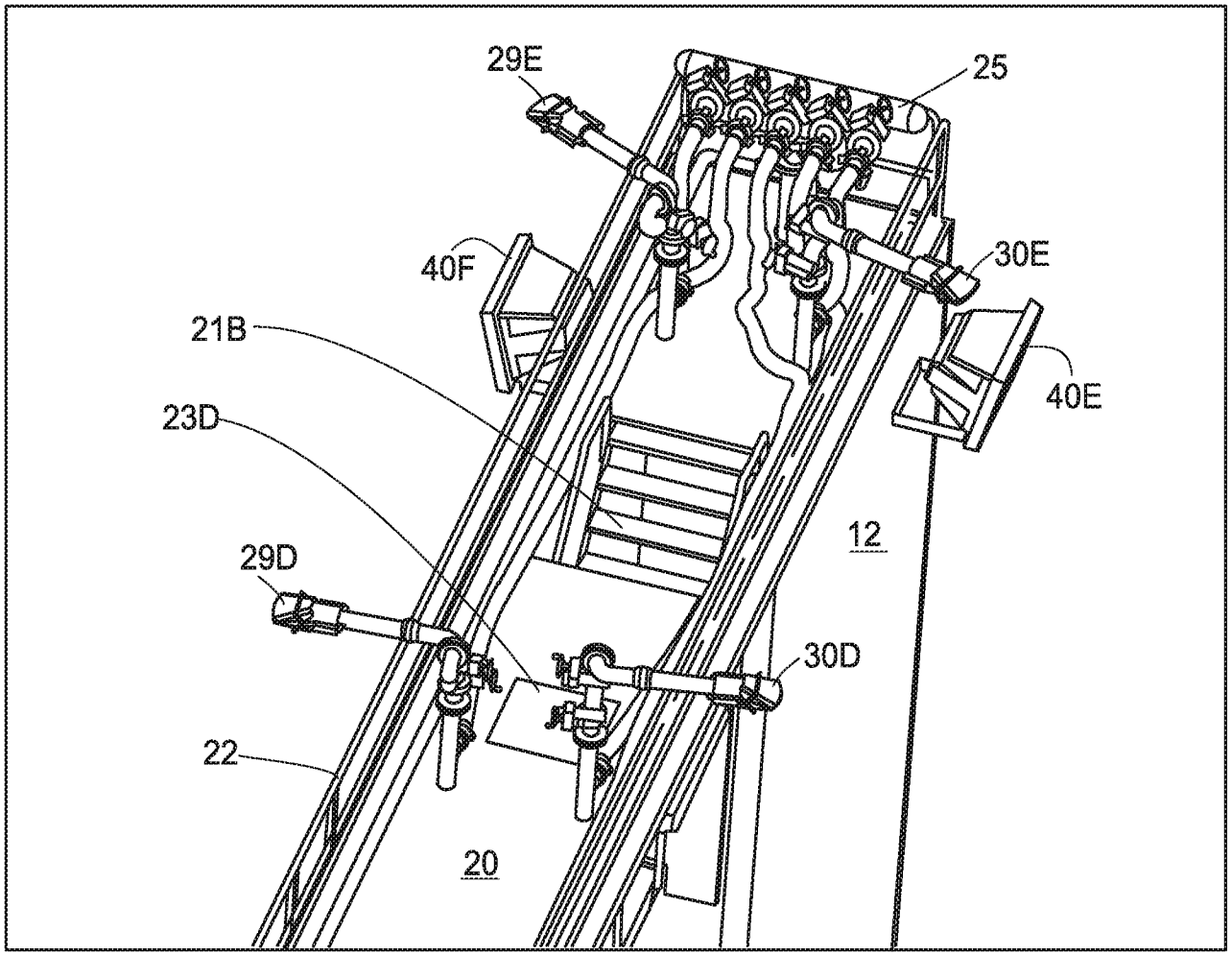
FIG. 3 depicts a partial overhead view of an embodiment of a firewall as described in the present disclosure.

Turning now to FIGS. 2-3, a more detailed view of the manned firefighting stations 28D and 28E are shown in relation to the valve control tree 25, located on the ceiling 20, proximate to the longitudinal wall 18. Hoses 29D, 29E extend past the lateral wall 14, while hoses 30D, 30E extend past the lateral wall 12. Also visible is lights 40E, 40F, second stairway entrance/exit 21B, and guardrails 22.

Turning now to FIG. 4, an overhead view of manned firefighting station 28A is shown proximate to valve control tree 24 and longitudinal wall 16 on ceiling 20, with hoses 29A and 2913 extending beyond the lateral walls as shown in FIGS. 2-3. As shown, the first stairway entrance/exit 21A, located in the ceiling and leading into the portable firewall, is covered by a door 50, (e.g., fireproof or blast resistant door, hatch-type door). Further, the portable firewall depicted in FIG. 4 includes a vent 23A for allowing for air exchange, and a fume hood 39A, lights 40A, 408, guardrails 22, and door 34F with an egress light 36F for indicating when the door is opened.

Figure 5:
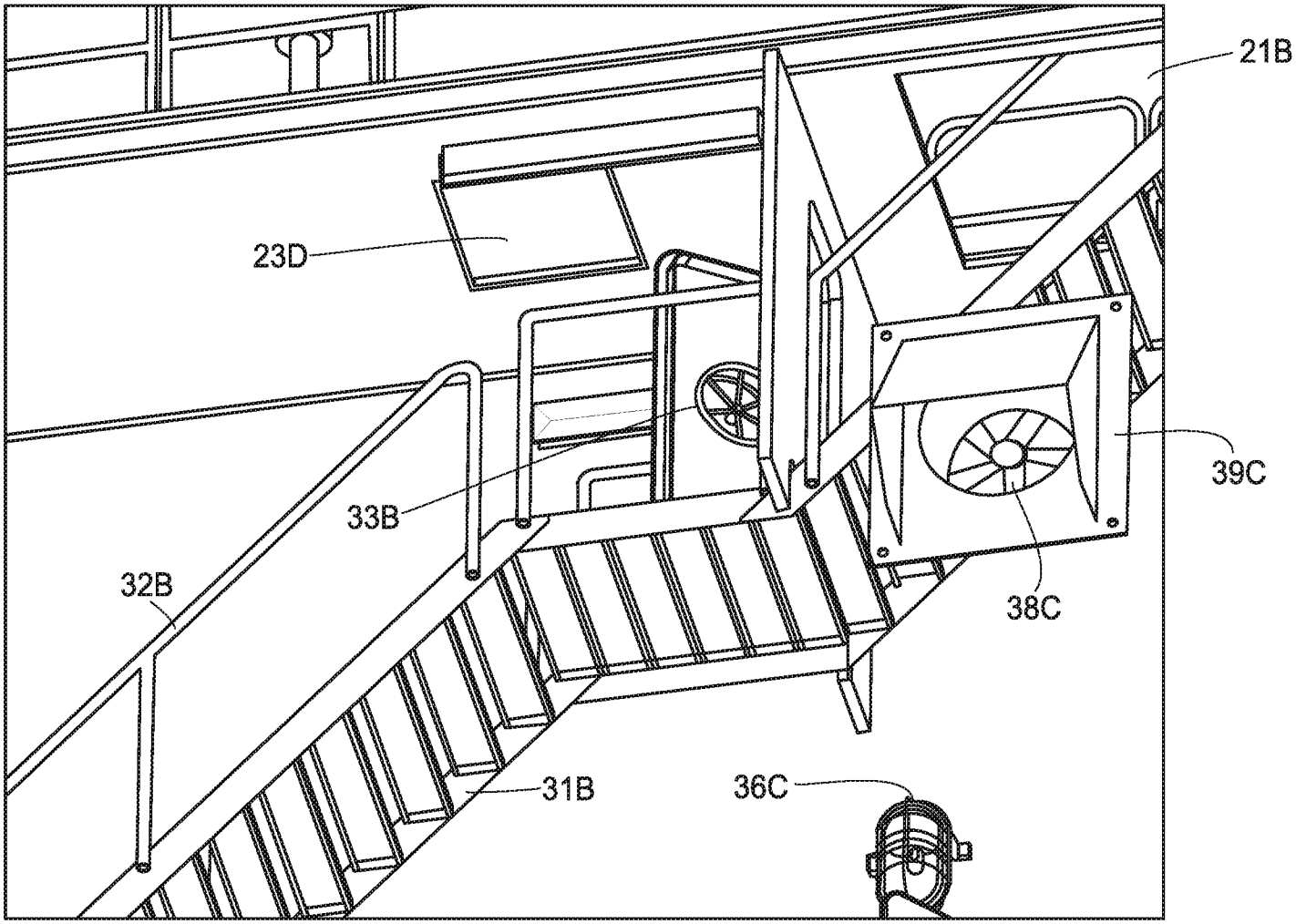
FIG. 5 depicts an internal, upward-facing of an embodiment of a firewall as described in the present disclosure.

Turning now to FIG. 5, an internal view of the stairway 31B is shown, with railing 32B, illustrating how the upper door 33B (and its counterpart 33A, not shown) acts to isolate the internal volume of the portable firewall 10 from the second stairway entrance/exit 21B. Also visible is vent 23D, fan 38C with fume hood 39C, and egress light 36C.

Figure 6:
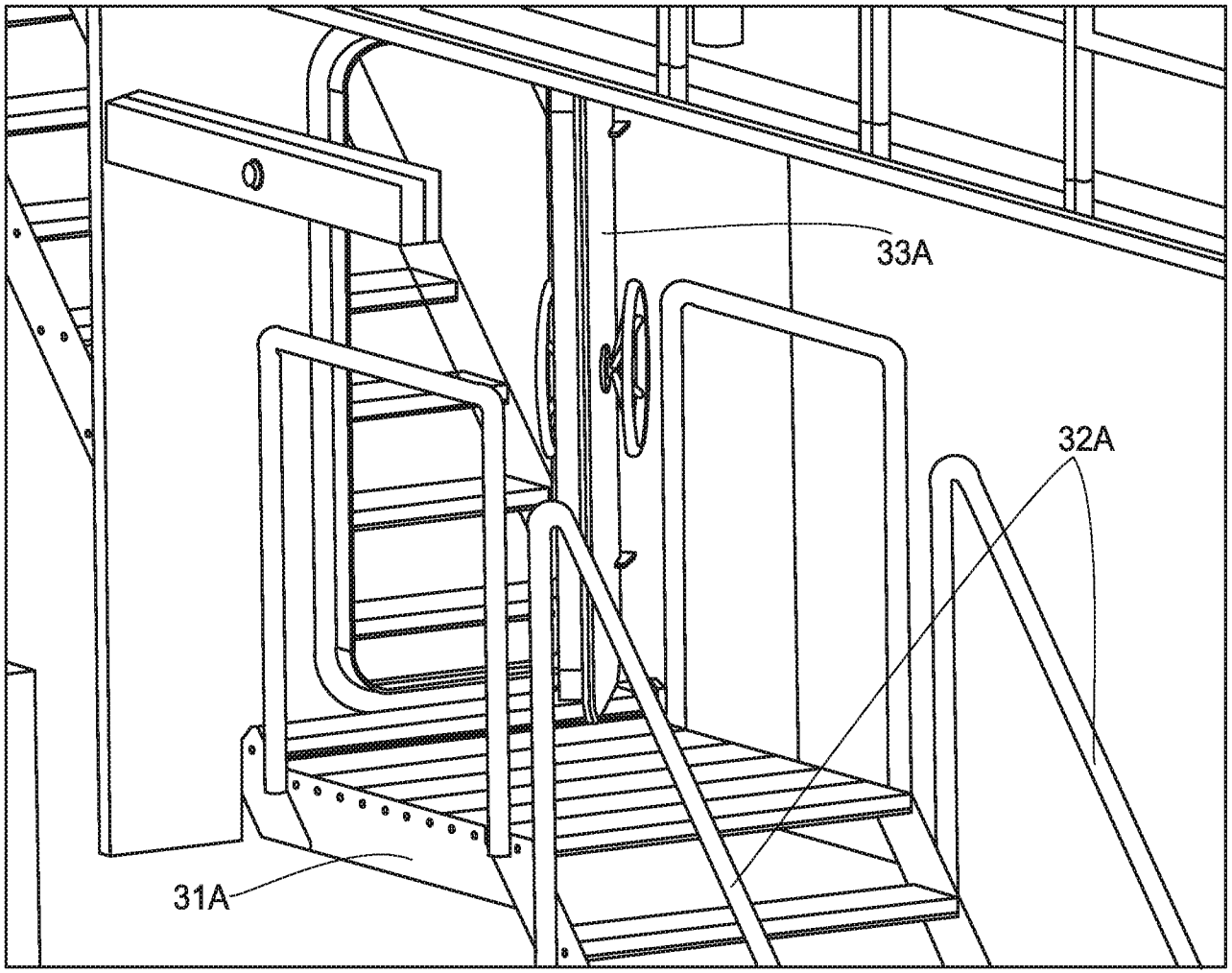
FIG. 6 depicts a close-in view of an egress path as described in the present disclosure.
Figure 7:
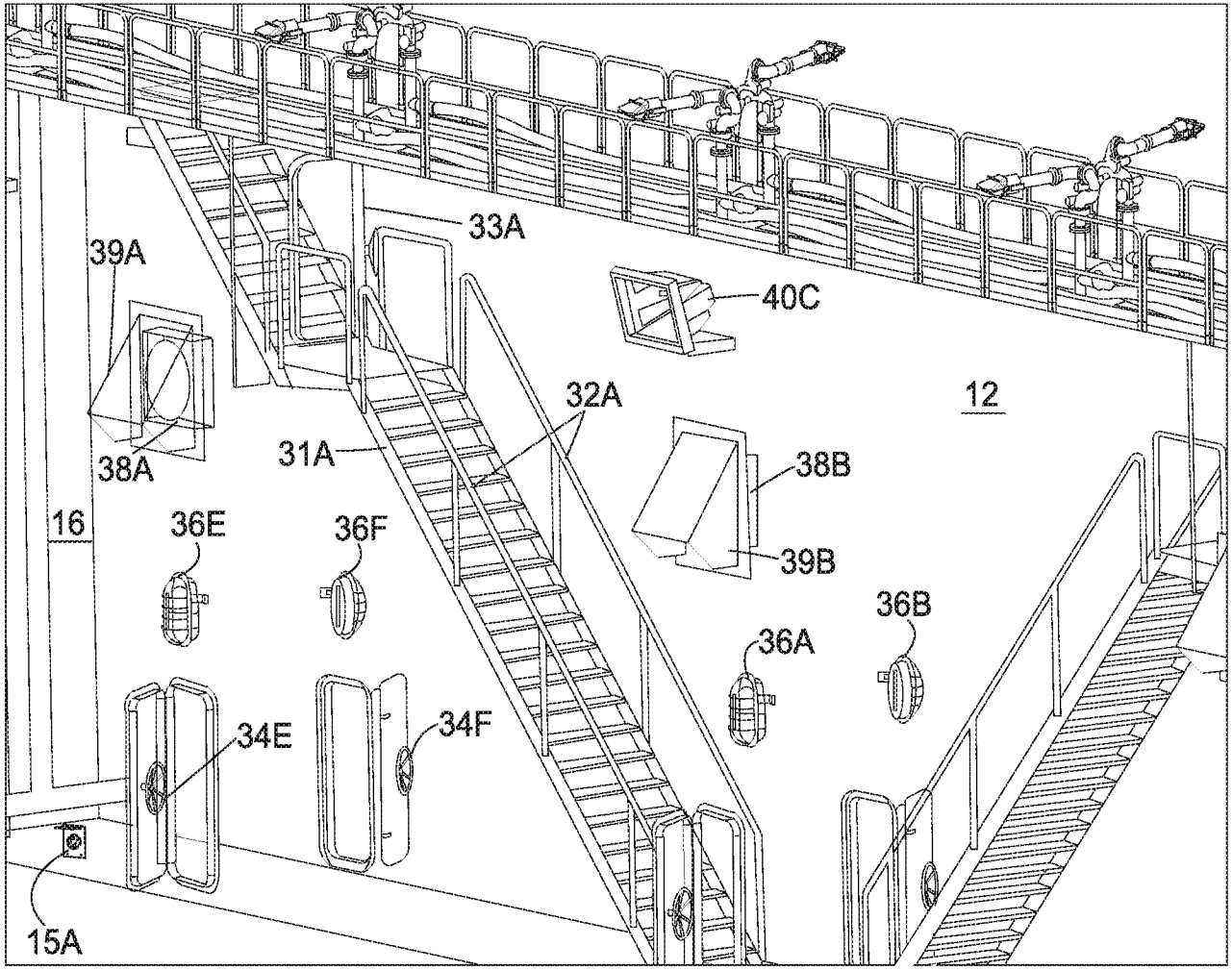
FIG. 7 depicts a zoomed, transparent view of an embodiment of a firewall as described in the present disclosure.

Turning now to FIGS. 6-7, a similar detailed view of upper door 33A is shown in relation to stairway 31A and railing 32A (in FIG. 6) and in relation to side doors 34E and 34F and their respective egress lights 36E and 36F in lateral wall 12 (in FIG. 7). Also visible in FIG. 7 are egress lights 36A, 36B, light 40C, and fans 38A, 38B with fume hoods 39A, 39B, as well as outlet 15A and longitudinal wall 16.

Figure 8:
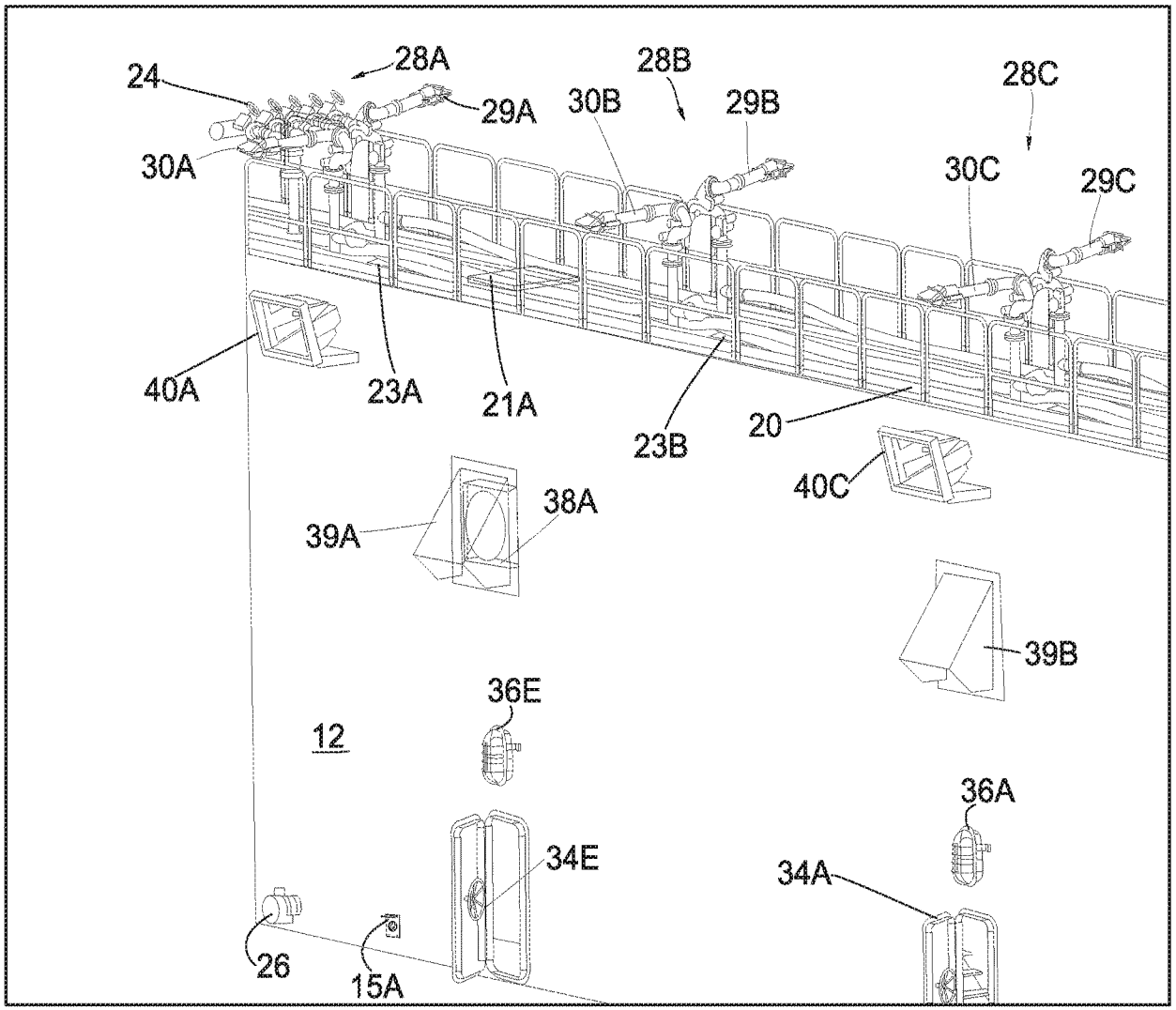
FIG. 8 depicts an opaque, perspective view of one side of an embodiment of a firewall as described in the present disclosure.
Figure 9:
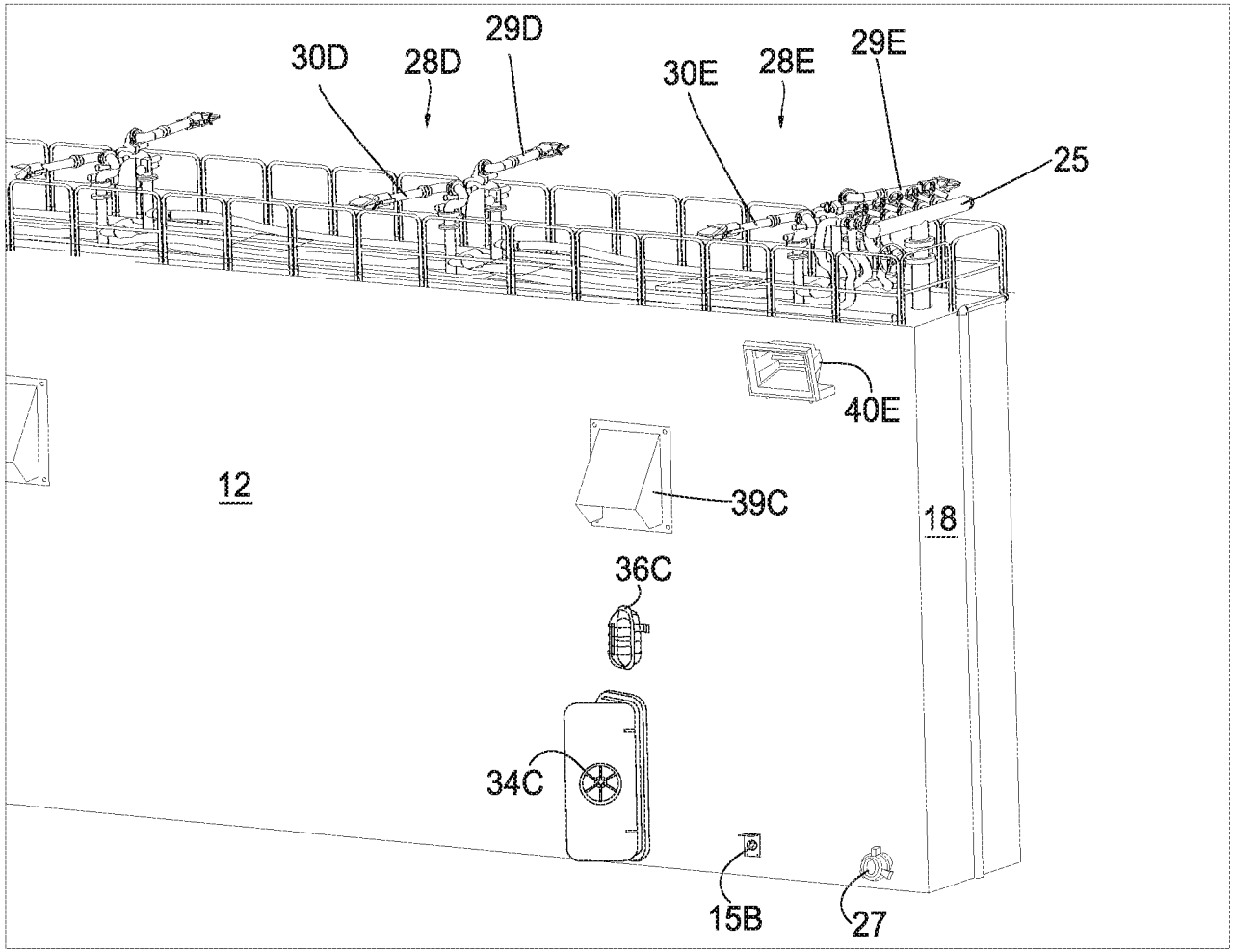
FIG. 9 depicts an opaque, perspective view of the other side of an embodiment of a firewall as described in the present disclosure.

Turning now to FIGS. 8-9, the lateral wall 12 is shown in an opaque view with the exception of fume hood 39A, which is transparent to indicate fan 38A. Fans 38B and 38C are not visible but are similarly positioned underneath fume hoods 39B and 39C. Each fume hood is positioned directly above a corresponding door; fume hood 39A with door 34E, fume hood 398 with door 34A, and fume hood 39C with door 34C. Additionally, the electrical outlets 15A, 15B are visible flanking the two side doors 34E, 34C respectively. Firefight stations 28A-E are visible, comprising hoses 29A-E and 30A-E, respectively, as well as valve control trees 24, 25, lights 40A, 40C, and 40E, and fluid inputs 26, 27. The ceiling 20 of the portable firewall includes vents 23A and 23B, and the first stairway entrance/exit 21A is shown covered by a door.

Figure 10:
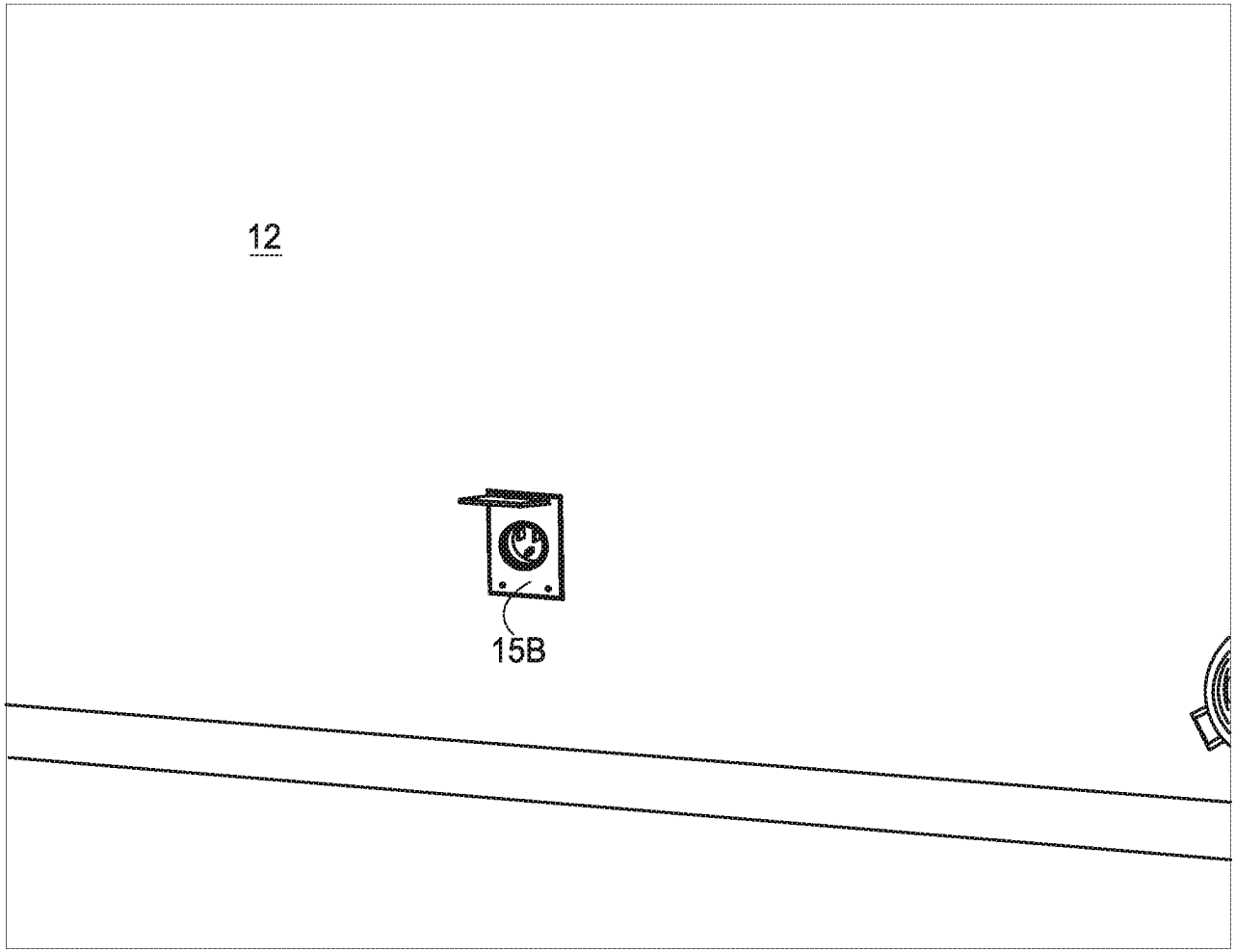
FIG. 10 depicts a zoomed-in view of the electrical outlet used in an embodiment of a firewall as described in the present disclosure.

Turning now to FIG. 10, the electrical outlet 15B is seen in a zoom on the lateral wall 12.

While various embodiments usable within the scope of the present disclosure have been described with emphasis, it should be understood that within the scope of the appended claims, the present invention can be practiced other than as specifically described herein.

The invention claimed is:

1. A firewall structure not integral to a pre-existing vessel or structure comprising:

an internal space enclosed by a first lateral wall, a second lateral wall, a first side wall, a second side wall, a floor, and a ceiling;

a first internal stairway located within the internal space and comprising an upper end and a lower end, the upper end of the internal stairway terminating at a first stairway entrance/exit located in the ceiling, the lower end of the stairway terminating adjacent to a fireproof or blast-resistant door in the first lateral wall;

a second internal stairway located within the internal space and comprising an upper end and a lower end, wherein the lower end of the first internal stairway terminates opposite the lower end of the second internal stairway;

wherein the first and second internal stairways comprise first and second intermediate doors, respectively, wherein the first and second intermediate doors are fireproof or blast-resistant and positioned on a respective first and second landing within the firewall to isolate the internal space from the first and second stairway entrance/exits, wherein the first and second landings are positioned intermediate the upper end and lower end of the first and second internal stairways;

a plurality of firefighting stations located along the ceiling, each firefighting station comprising a first pressurized hose extending beyond the first lateral wall, and a second pressurized hose extending beyond the second lateral wall;

at least one valve control tree fluidly connected to the plurality of firefighting stations, wherein the at least one valve control tree communicates fluid received from a fluid input; and a plurality of vents located along the ceiling, wherein the firewall structure is capable of being bolted or welded within the pre-existing vessel or structure to provide fire resistance.

2. The firewall of claim 1, further comprising wherein the upper end of the second internal stairway terminates at a second stairway entrance/exit located in the ceiling, and wherein the lower end of the second internal stairway terminates adjacent to a second fireproof or blast-resistant door in the second lateral wall.

3. The firewall of claim 2, wherein the first fireproof or blast-resistant door and the second fireproof or blast-resistant door are centrally located at the floor of the firewall, and wherein the first stairway entrance/exit and the second stairway entrance/exit are distally located proximate to the first side wall and the second side wall, respectively.

4. The firewall of claim 3, wherein the first lateral wall further comprises a third fireproof or blast-resistant door and a fourth fireproof or blast-resistant door distally located at the floor of the firewall, proximate to the first side wall and the second side wall, respectively, and wherein the second lateral wall further comprises a fifth fireproof or blast-resistant door and a sixth fireproof or blast-resistant door distally located at the floor of the firewall, proximate to the first side wall and the second side wall, respectively.

5. The firewall of claim 4, wherein the first lateral wall further comprises three egress lights corresponding and adjacent to the first fireproof or blast-resistant door, the third fireproof or blast-resistant door, and the fourth fireproof or blast-resistant door, respectively, and wherein the second lateral wall further comprises three egress lights corresponding and adjacent to the second fireproof or blast-resistant door, the fifth fireproof or blast-resistant door, and the sixth fireproof or blast-resistant door, respectively, wherein each of the egress lights indicates whether the corresponding door is opened.

6. The firewall of claim 1, further comprising a plurality of fans in the first lateral wall to stimulate air exchange through the plurality of vents, wherein each fan of the plurality of fans is partially enclosed by a fume hood.

7. The firewall of claim 1, wherein the at least one valve control tree is located proximate to the first side wall, and wherein the fluid input communicates with the at least one valve control tree by means of a conduit extending along the first side wall.

8. The firewall of claim 7, further comprising at least a second valve control tree located on the ceiling proximate to the second side wall, wherein the at least a second valve control tree is in fluid communication with the plurality of firefighting stations, and wherein the at least a second valve control tree communicates with a second fluid input by means of a conduit extending along the second side wall.

9. The firewall of claim 1, further comprising a railing extending upwards from the first and second lateral walls and the first and second side walls, thereby enclosing the ceiling.

10. The firewall of claim 1, wherein the first lateral wall, the second lateral wall, or combinations thereof further comprise a plurality of lights proximate to the ceiling.

11. The firewall of claim 1, further comprising at least one 240V outlet.

12. The firewall of claim 1, wherein the first and second lateral walls comprise a length greater than the length of the first and second side walls.

* * * * *